US005539420A

United States Patent [19]

Dusseux et al.

[11] Patent Number: 5,539,420

[45] Date of Patent: Jul. 23, 1996

[54] MULTILAYERED, PLANAR ANTENNA WITH ANNULAR FEED SLOT, PASSIVE RESONATOR AND SPURIOUS WAVE TRAPS

[75] Inventors: Thierry Dusseux, Tournefeuille; Michel Gomez-Henry, L'Union; Michel Lairle, Villeneuve Tolosane; Gérard Raguenet, Eaunes, all of France

[73] Assignee: Alcatel Espace, Courbevoie, France

[21] Appl. No.: 268,735

[22] Filed: Jun. 30, 1994

Related U.S. Application Data

[63] Continuation of Ser. No. 882,760, May 11, 1992, abandoned, which is a continuation of Ser. No. 580,457, Sep. 11, 1990, abandoned.

[30] Foreign Application Priority Data

Sep. 11, 1989 [FR] France ..... 89 11829

[51] Int. Cl.[6] ..... H01Q 1/38

[52] U.S. Cl. ..... 343/769; 343/700 MS

[58] Field of Search ..... 343/700 MS, 767, 343/771, 789, 769, 846; H01Q 1/38, 13/08, 13/18

[56] References Cited

U.S. PATENT DOCUMENTS

| | | | |
|---|---|---|---|
| 3,665,480 | 5/1972 | Fassett | 343/700 MS |
| 4,208,660 | 6/1980 | McOwen | 343/769 |
| 4,443,802 | 4/1984 | Mayes | 343/729 |
| 4,710,775 | 12/1987 | Coe | 343/727 |
| 4,719,470 | 1/1988 | Munson | 343/700 MS |
| 4,792,810 | 12/1988 | Fukuzawa et al. | 343/700 MS |
| 4,958,165 | 9/1990 | Axford et al. | 343/770 |

FOREIGN PATENT DOCUMENTS

| | | | |
|---|---|---|---|
| 0064313 | 11/1982 | European Pat. Off. | H01Q 1/38 |
| 0207029 | 12/1986 | European Pat. Off. | H01Q 9/04 |
| 0271458 | 6/1988 | European Pat. Off. | H01Q 21/06 |
| 0315141 | 5/1989 | European Pat. Off. | H01P 1/17 |
| 2603744 | 3/1988 | France | H01G 13/20 |
| 160103 | 12/1981 | Japan | 343/700 MS |
| 15902 | 1/1987 | Japan | 343/700 MS |

OTHER PUBLICATIONS

Patent Abstracts of Japan, vol. 13, No. 232 (E–765)(3580) May 29, 1989; & JP–A–13 9102 (Matsushita Electric Works) Feb. 9, 1989.

L'Onde Electrique vol. 69, No. 2, Mars/Avril, 1989, pp. 15–21, Paris, France, by Albert Papiernik "Les activites du Groupement de Recherche microantennes du CNRS([1])".

Nurie et al, "Crossover Performance of Annular–Ring Microstrip Antenna With Novel Mode Suppression", Electronics Letters, vol. 25, No. 10 11 May 1989 pp. 656–657.

*Primary Examiner*—Michael C. Wimer

*Attorney, Agent, or Firm*—Sughrue, Mion, Zinn, Macpeak & Seas

[57] ABSTRACT

A plane antenna suitable for space applications in particular comprises a passive resonator coupled to a feedline by a looped slot.

15 Claims, 3 Drawing Sheets

MULTILAYERED, PLANAR ANTENNA WITH ANNULAR FEED SLOT, PASSIVE RESONATOR AND SPURIOUS WAVE TRAPS

This is a Continuation of application Ser. No. 07/882,760, filed May 11, 1992, now abandoned, which is a Continuation of application Ser. No. 07/580,457, filed Sep. 11, 1990, now abandoned.

BACKGROUND OF THE INVENTION

1. Field of the Invention

The invention concerns a plane, for example, printed-circuit or microstrip, antenna radiating circularly or linearly polarized waves. The invention may be applied to the excitation of a circular or linear polarization waveguide.

An antenna of this kind in accordance with the invention provides a compact transition between TEM (transverse electromagnetic) feedlines such as triplate (i.e., a suspended stripline), microstrip, coaxial, bar-line feedlines (this list is not exhaustive) and free space (or a waveguide).

2. Description of the Prior Art

Known systems for providing a transition between a TEM guided wave and free space comprise:

systems made up of an exciter and a horn: the overall size is then large (length greater than a wavelength), microstrip antennas: the overall size is then reduced (length less than a half-wavelength).

The antenna in accordance with the invention is a microstrip antenna offering improved performance.

Known devices in this category comprise:

Double resonators of square, circular, etc. shape fed by orthogonal coaxial feedlines. The excitation feedlines render the radiation asymmetrical. Also, a device of this kind involves soldering.

Double or single resonators respectively fed by a linear slot or a coupling hole. A device of this kind does not require any soldering. Also, the excitation does not render the diagram asymmetrical if the coupling slot or hole is disposed symmetrically to the resonator (of square, circular, etc. shape). In the case of a circularly polarized wave or double linear polarization it is then necessary to render the excitation asymmetrical or to cross the feedlines (cross-shape slot).

Electromagnetic coupling. A device of this kind does not require any soldering. Radiation is degraded by radiation from the line on the radiating side.

Known compact systems providing a transition between a TEM guided wave and a wave guide comprise:

Resonators disposed at the bottom of the guide. The performance, bandwidth and polarization purity are then rarely compatible with telecommunication bands.

Double resonators fed by coaxial feedlines. A device of this kind requires three different stages:

TEM line excitation stage, active resonator stage, passive resonator stage.

In French patent application No 87 15359 the device for exciting a guide has two stages only for performance equivalent to that of a conventional diplexer and does not require any soldering.

An object of the invention is to improve the specifications of the prior art device.

SUMMARY OF THE INVENTION

The invention consists in a plane antenna comprising a passive resonator coupled to a feedline by an endless slot.

The invention advantageously has a greater bandwidth than the prior art devices. Also, it is well adapted to conserving radiation symmetry in the case of circular polarization or double linear polarization.

Its performance characteristics are as follows:

increased bandwidth, very pure polarization for circular or linear polarization with one or two ports, very symmetrical excitation, the feedlines being screened on the excited wave side.

An antenna of this kind can be used in a multi-source antenna (antenna array) employing frequency re-use with circular or linear polarization. It may also be used in a direct radiating multi-source or array antenna in which only one type of polarization of the wave is excited.

The characteristics and advantages of the invention will emerge from the following description by way of non-limiting example with reference to the appended diagrammatic drawings.

DETAILED DESCRIPTION OF THE INVENTION

Figure 1:
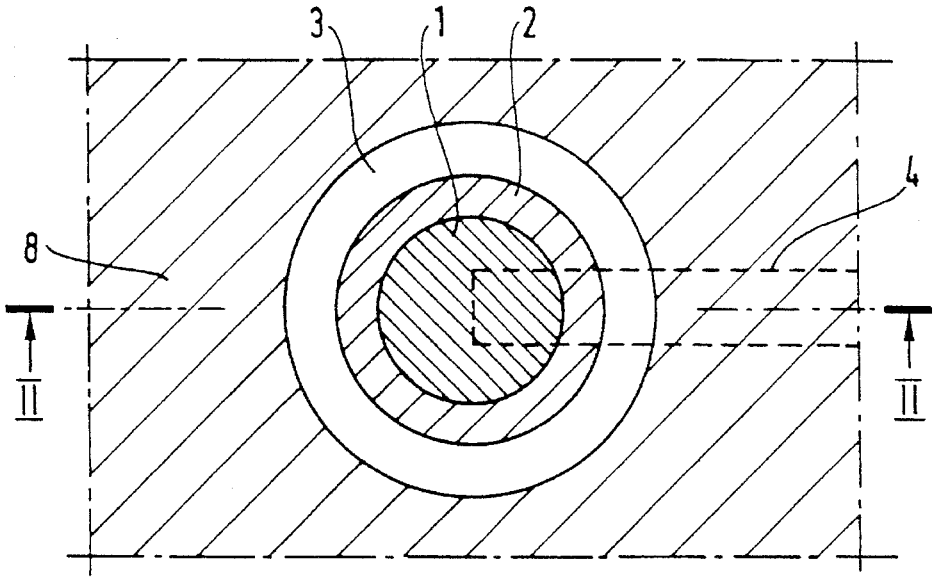
FIGS. 1 and 2 a respectively a front view and a longitudinal cross-section on the line II—II in FIG. 1 of a device in accordance with the invention
Figure 2:
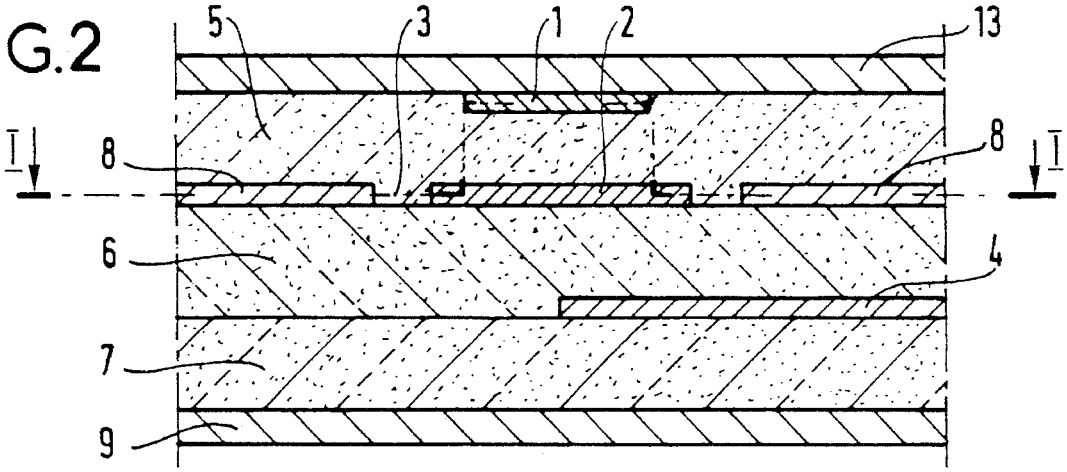

As shown in FIGS. 1 and 2, the device in accordance with the invention comprises a passive resonator 1 of any shape, for example round or square. The resonator 1 is a printed-circuit or microstrip conductor at the operating frequency, the center of which can be open. The resonator 1 may be made up of multiple resonators which may be superposed.

The resonator is coupled to the feedline or conductor 4 by a circular, square or other shape endless annular slot 3 of constant or varying width. The slot 3 is formed by the gap between a conductor or conductive plane 8 and a conductor, i.e. a disk, square or other shape area of conductive material.

The conductors 8 and 2 may be printed or etched.

The feedline 4 may be a triplate or microstrip line. It may be enclosed between two ground planes 8 and 9. The second ground plane 9 may be omitted if radiation on the feedline side is sufficiently weak (microstrip line feed).

The antenna in accordance with the invention has various dielectric spacers 5, 6 and 7. These may be homogeneous or otherwise, partial or complete, and of variable height according to the layer in question and the required performance. These spacers may be made from a low dielectric permittivity material, especially the spacer 5. If the spacer 6 and 7 are identical in terms of height and radioelectric qualities, the feedline is then of the triplate or bar-line type, depending on the thickness of the conductor 4. The materials of the spacers 6 and 7 are usually of the same or higher permittivity than that of the spacer 5.

If the spacers 6 and 7 are different the feedline is of the screened microstrip type. The permittivity of the spacer 6 can then be higher than that of the spacer 7. The thickness of the spacer 6 is then less than that of the spacer 7.

The resonator 1 may be covered with a non-conductive protective material 13.

The feedline 4 is generally radial and feeds the slot 3 by electromagnetic coupling, typically by means of a quarter-wave stub terminating at an open circuit. The slot is then coupled to the resonator 1. This combination makes it possible to obtain a wide bandwidth, typically 20% with a standing wave ratio of less than 1.2 on substrates in air.

The maximum radiation is then perpendicular to the conductors 8 and 2, in a direction parallel to that of the arrow I in FIG. 2. The ground plane 8 and the conductor 2 then mask radiation from the feedline. The radiation is highly symmetrical and the level of cross polarization is low.

The annular slot 3 may be excited in ways known to those skilled in the art:

coupling by radial quarter-wave section, coupling by tangential line, excitation by coaxial feedline (which involves soldering), excitation via a short-circuit.

Figure 3:
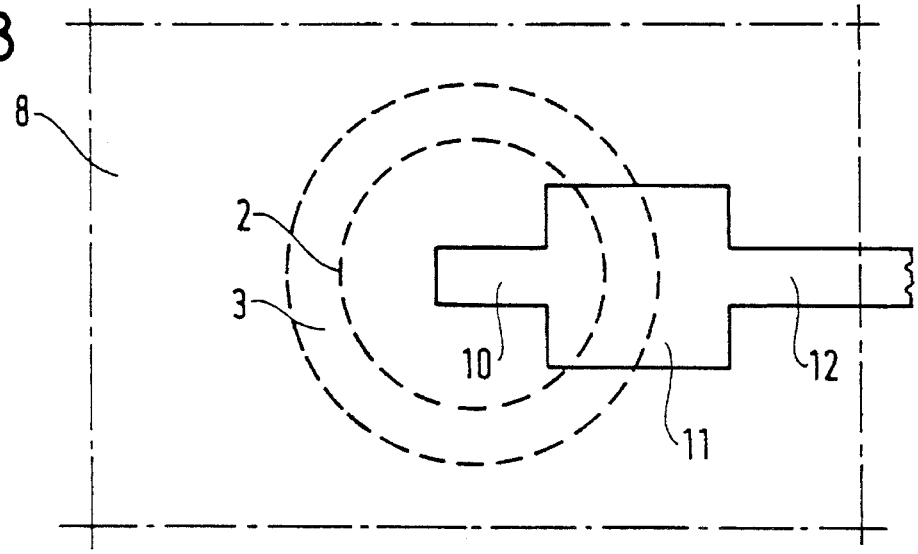
FIG. 3 shows the contactless feedlines.

FIG. 3 shows the excitation of the annular slot 3 by a radial quarter-wave section 10. The excitation may be by means of a triplate, microstrip, etc. line 12. Section 10 is a stub terminating at an open circuit, its length approximately a quarter the guide wavelength. The open circuit at its end is transformed into a short-circuit in the plane of the slot, allowing excitation of the slot. The section 11 is an impedance matching section whose length is approximately one quarter the waveguide wavelength, enabling matching of the device to any required impedance (50 ohms, for example). The line 12 is then an access line to the device conveying the exchanged power.

Depending on the geometry of the device, the plane of excitation of the slot may to some extent be between the center of symmetry of the device and the slot, as shown in FIG. 3.

Typical dimensions are as follows:

Diameter of the resonator 1 less than a half-wavelength.

Diameter of the annular slot 3 in the order of a half-wavelength. This diameter is inversely proportional to the relative permittivity of the spacer 6. The circumference of the slot may be greater than the wavelength. The slot 3 is resonant.

Heights of the spacers 5 and 6 a few fractions of a wavelength.

Figure 4:
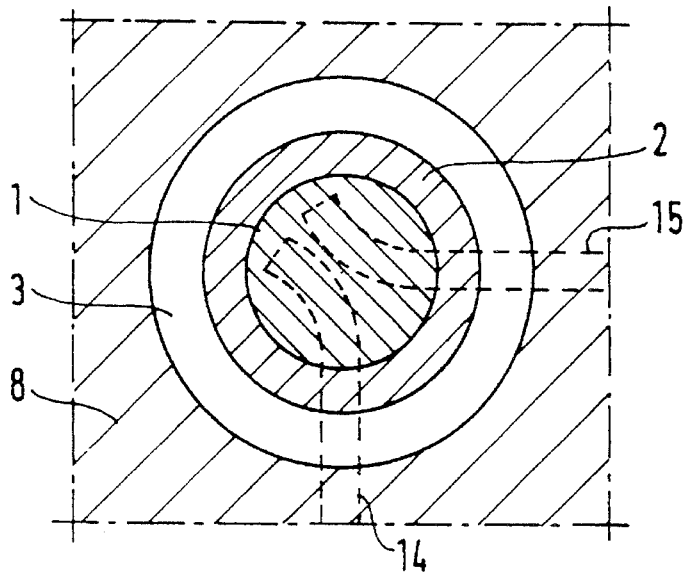
FIG. 4 shows an orthogonal feedline topology able to generate two independently linearly polarized waves or two opposed circularly polarized waves if the lines are connected to a quadrature device.

In a first embodiment of the invention shown in FIG. 4 the antenna in accordance with the invention is fed at two orthogonal positions (spaced by 90° in the plane of the line parallel to the conductor 8). The types of excitation are those known to those skilled in the art as described previously. The antenna can then:

generate two spatially orthogonal linear polarized waves (vertical and horizontal polarization, for example) which are independent of each other as the two ports are decoupled; this system then makes it possible to benefit from the symmetrical radiation of the device for each of the ports;

generate one or two circular polarized waves using a quadrature device (coupler, 90° hybrid, Tee connector plus length of line), whilst retaining the symmetry of the device.

FIG. 4 shows a front view of the device in the case of double feed by open circuit quarter-wavelength sections. The lines 14 and 15 each cross the slot perpendicularly (radially) and, depending on their length, can adopt a non-rectilinear shape under the conductor 2, diverging to reduce the coupling. The lines 14 and 15 are structured as explained in the description with reference to FIG. 3.

Figure 5:
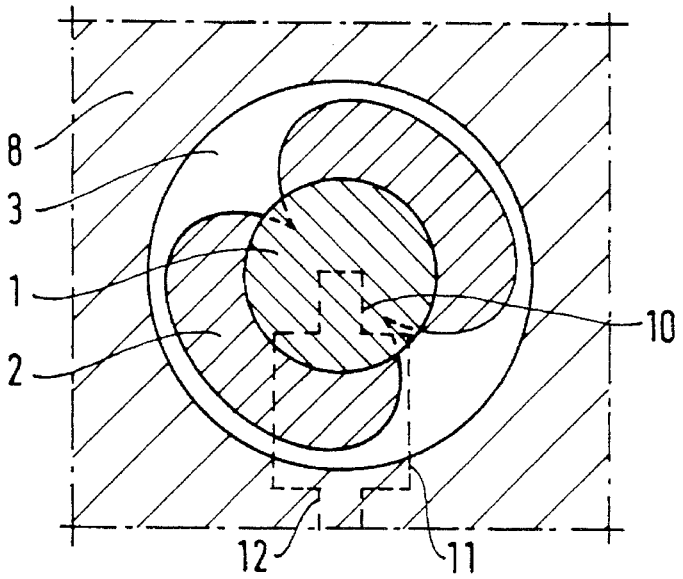
FIG. 5 shows an embodiment of the invention in which a circularly polarized wave is generated with one port only.
Figure 6:
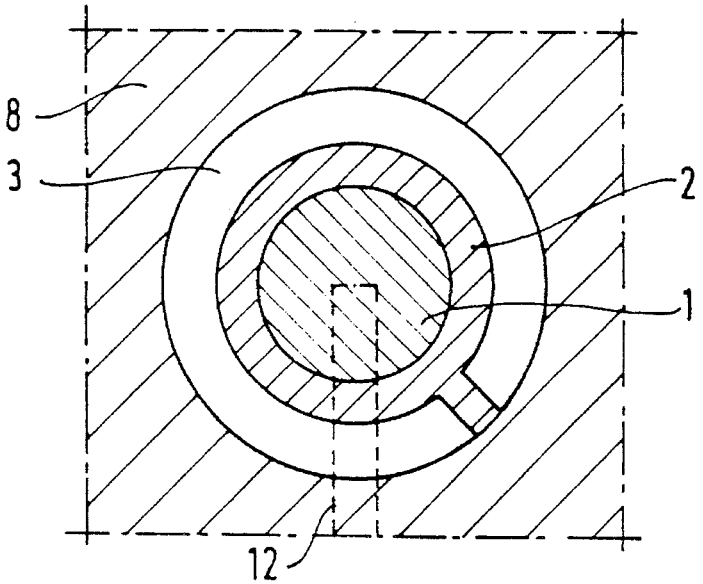
FIG. 6, 7 and 8 show two variations on the embodiment shown in FIG. 5.
Figure 7:
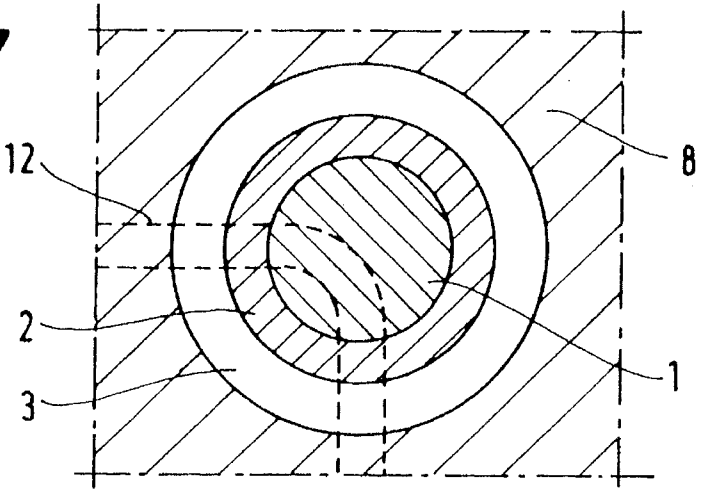

FIGS. 5, 6 and 7 show embodiments of the invention which generate circular polarization with a single port.

Those skilled in the art know that asymmetry in a microstrip antenna is liable to create a circularly polarized wave.

The antenna in accordance with the invention can therefore also be used with the addition of such asymmetry. In particular, notches may be used on the conductor 2 or the conductor 1 or both, tabs on the conductor 2 or the conductor 1 or both, or a slot in conductor 2 or conductor 1 or both. The object of these modifications is to render the radiating structure asymmetrical.

FIG. 5 shows notches disposed diagonally across ground plane 8, the width of the notches decreasing progressively towards the center of the antenna. This shape of the conductor 2 optimizes the ellipse ratio over a wide bandwidth (less than 1 dB for a bandwidth approaching 8%).

FIG. 6 shows another way to generate a circularly polarized wave with one port: on one diagonal as a thin radial conductor portion 2*a* short-circuiting the slot 3 between the conductors 8 and 2.

FIG. 7 shows another embodiment in which the feedlines pass under the slot at two orthogonal locations. The length of the line between the two crossings is in the order of a quarter-wavelength. The line is closed by an open circuit quarter-wavelength section, as described with reference to FIG. 3.

Figure 8:
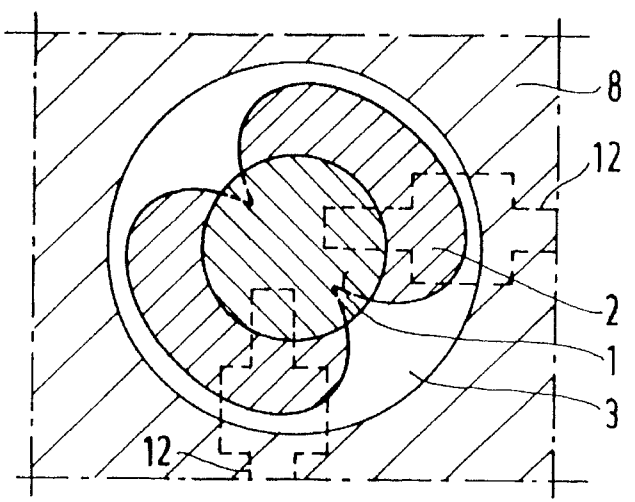

To provide two ports generating circular polarization independently, the embodiments described previously (in particular those of FIGS. 5 and 6) can be provided with a second port or line 12 symmetrical to the first relative to the asymmetry shown in FIG. 8.

Everything described so far is applicable if the free space beyond the non-conductive protective material 13 is replaced by a cylindrical waveguide (of circular, square, elliptical, etc. cross-section) with its propagation axis coincident with an axis of symmetry perpendicular to the conductor 8. The axis of symmetry of the waveguide passes through the axis of symmetry of the conductors 1 and 2. The metal walls of the waveguide contact the device through contact with the conductors 8 or 9.

Figure 10:
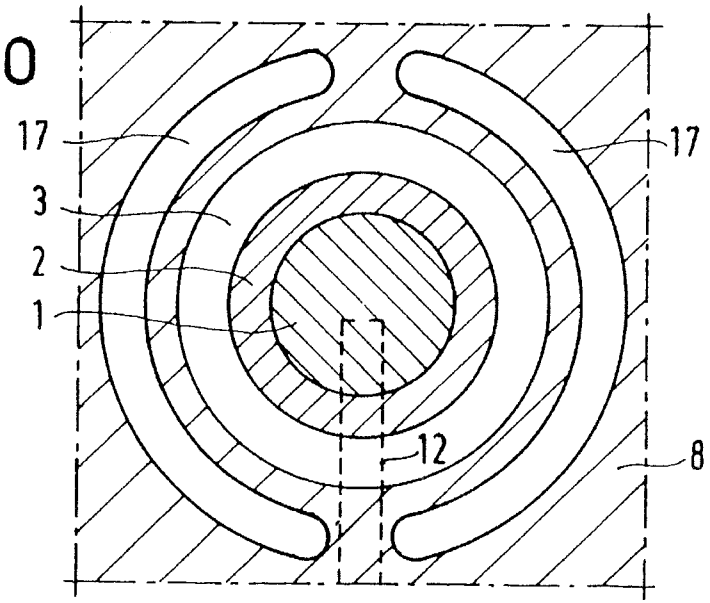
FIGS. 9 and 10 show the device in accordance with the invention associated with traps for a parallel plane waveguide.
Figure 9:
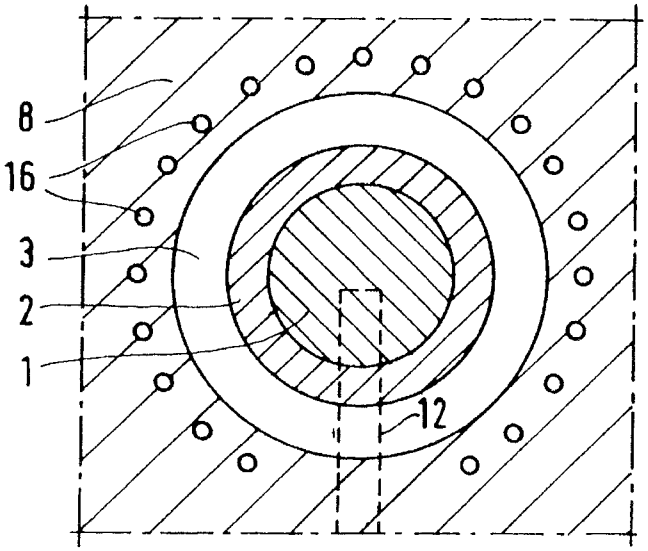

If the device in accordance with the invention is fed by a feedline 4 in the presence of two conductive planes 8 and 9 it is possible for the waveguide constituted by the two conductors 8 and 9 to be excited by the asymmetry caused by the slot in one of the conductors. This phenomenon can degrade potential performance. In this case the device may be provided with traps for this spurious wave:

at the periphery of the slot 3, between the conductors 8 and 9, discrete or continuous short-circuits 16 may be added, as shown in FIG. 9; a cavity of any shape short-circuiting the parallel plane waveguide is then formed; its greater dimension is less than the wavelength and must be minimized to reduce the overall size of the cavity; the cavity must allow the feedline or lines to pass;

the cavity may be replaced by resonant metal studs;

the cavity may be formed by a sudden reduction in the gap between the conductors 8 and 9, without them necessarily coming into contact; the closer spacing of the two conductors constitutes a high capacitance which short-circuits the spurious wave at the operating frequency;

the excitation of the parallel plane guide can be controlled by forming cut-outs 17 around the slot 3 in the conductor 8, at least partially forming annular slot 3, as shown in FIG. 10; these constitute open-circuits for the parallel plane guide; they must not disrupt propagation along the feedlines 12; these cut-outs may be any shape, but they do affect the required performance.

Both these latter methods involve no soldering.

Other embodiments of the device are possible:

two or more than two resonators may be used to increase the bandwidth or directivity, the previous embodiments may be used in free space and also with a waveguide.

The present invention has been described and shown by way of preferred example only and its component parts can be replaced by equivalent parts without departing from the scope of the invention.

There is claimed:

1. Planar antenna comprising in a stacked array successively:

a passive resonator;

a first dielectric spacer;

a first planar conductor;

at least one conductive material element;

an endless slot formed in the plane of the first planar conductor by a gap between said first planar conductor and said at least one conductive material element, said at least one conductive material element being situated in the same plane as the first planar conductor;

a second dielectric spacer;

at least one feedline;

a third dielectric spacer;

a second planar conductor;

a spacing between said first and second planar conductors effected by disposing said second and third dielectric spacers between said planar conductors;

said resonator being coupled in a contactless manner to said at least one feed line by means of said endless slot; said coupling depending on the conductive material element shape; said planar antenna further comprising: spurious wave blocking means formed in said first planar conductor around the outside of the endless slot for avoiding any spurious wave due to an excitation guide which is constituted by the planar conductors due to asymmetry caused by the endless slot; said spurious wave blocking means being constituted by open circuits in the plane of the first planar conductor.

2. Antenna according to claim 1, wherein said endless slot is an annular slot.

3. Antenna according to claim 1, wherein said at least one feedline comprises two feedlines, and wherein orthogonally polarized waves are generated with said two feedlines.

4. Antenna according to claim 3, wherein said two feedlines cross the slot radially towards the center of the slot.

5. Antenna according to claim 1, wherein at least one of said resonator and said slot is disposed asymmetrically relative to said at least one feedline to generate circular polarization.

6. Antenna according to claim 5, wherein said asymmetry is provided by at least one conductor in the plane of the first planar conductor, said at least one conductor short-circuiting the endless slot between the first planar conductor and the conductive material element.

7. Antenna according to claim 5, wherein said asymmetry is provided by diametrically opposite notches partially forming said slot and having a width which decreases progressively radially towards the center of said at least one conductive material element.

8. Antenna according to claim 1, wherein said feedline feeds the slot in a single branch at two orthogonal positions to generate circular polarization.

9. Antenna according to claim 5, wherein said at least one feedline comprises two feedlines including a second feedline to generate a circularly polarized wave orthogonal to a wave generated with a first feedline.

10. Antenna according to claim 1, wherein said spurious wave blocking means is constituted by open circuits constituted by arcuate cutouts formed in the first planar conductor, said cutouts being formed around said endless slot.

11. Antenna according to claim 2, wherein said spurious wave blocking means is constituted by open circuits constituted by arcuate cutouts formed in the first planar conductor, said cutouts being formed around said annular slot.

12. An antenna according to claim 1, wherein said at least one conductive material element is a solid planar disk.

13. The antenna according to claim 1, wherein: said first dielectric spacer has a lower dielectric permittivity than said second and third dielectric spacers; said second and third dielectric spacers have a same thickness and permittivity; and said at least one feedline is a triplate feedline.

14. The antenna according to claim 1, wherein: said first dielectric spacer has a lower dielectric permittivity than said second and third dielectric spacers; said second dielectric spacer has a higher dielectric permittivity than said third dielectric spacer; said second dielectric spacer has a thickness which is less than a thickness of said third dielectric spacer; and said feedline is a screened microstrip feedline.

15. The antenna according to claim 1, wherein said first dielectric spacer has a lower dielectric permittivity than said second and third dielectric spacers; said second and third dielectric spacers have a same thickness and permittivity; and said at least one feedline is a bar-line feedline.

* * * * *